US007856937B2

(12) United States Patent
Chapdelaine et al.

(10) Patent No.: US 7,856,937 B2
(45) Date of Patent: Dec. 28, 2010

(54) PERSONAL WATERCRAFT BALLAST

(75) Inventors: Benoit Chapdelaine, St-Denis de Brompton (CA); Jean-Guy Patry, Granby (CA); Andre Lettre, Granby (CA)

(73) Assignee: Bombardier Recreational Products Inc., Valcourt (CA)

( * ) Notice: Subject to any disclaimer, the term of this patent is extended or adjusted under 35 U.S.C. 154(b) by 443 days.

(21) Appl. No.: 12/055,972

(22) Filed: Mar. 26, 2008

(65) Prior Publication Data

US 2009/0241822 A1 Oct. 1, 2009

(51) Int. Cl.
*B63B 39/03* (2006.01)

(52) U.S. Cl. ..... 114/125; 114/55.5; 114/55.51

(58) Field of Classification Search ..... 114/125, 114/55.5, 55.51
See application file for complete search history.

(56) References Cited

U.S. PATENT DOCUMENTS

| | | | | |
|---|---|---|---|---|
| 2,683,269 | A | 7/1954 | Harkins | |
| 2,757,629 | A | 8/1956 | Wiltse | |
| 3,085,535 | A | 4/1963 | Hunt | |
| 3,186,371 | A | 6/1965 | Moore | |
| 3,311,083 | A | 3/1967 | Carlson | |
| 3,503,358 | A | 3/1970 | Moesly | |
| 4,005,670 | A | 2/1977 | Zaninovich et al. | |
| 4,341,177 | A * | 7/1982 | Miyazaki et al. | 114/125 |
| 4,528,927 | A | 7/1985 | Iizuka et al. | |
| 4,683,829 | A | 8/1987 | Nishida | |
| 4,700,650 | A | 10/1987 | Nishida | |
| 5,050,517 | A * | 9/1991 | Kobayashi | 114/123 |
| 5,140,922 | A | 8/1992 | Bowman et al. | |
| 5,215,025 | A | 6/1993 | Talmor | |
| 5,520,133 | A | 5/1996 | Wiegert | |
| 5,787,835 | A | 8/1998 | Remnant | |
| 6,044,788 | A * | 4/2000 | Larson et al. | 114/253 |

(Continued)

FOREIGN PATENT DOCUMENTS

EP 0244368 A1 11/1987

(Continued)

OTHER PUBLICATIONS

English Abstract of Japanese publication No. JP2262492.

(Continued)

*Primary Examiner*—Stephen Avila
(74) *Attorney, Agent, or Firm*—Osler, Hoskin & Harcourt LLP

(57) ABSTRACT

A personal watercraft has a hull and a deck. The deck includes a pedestal, two gunnels, two footrests, and a rear platform. A straddle-type seat is disposed on the pedestal. A steering assembly is disposed at least in part forwardly of the seat. An engine is supported by the hull. A propulsion system is connected to the hull and is operatively connected to the engine. A ballast tank is disposed at least in part on the rear platform. The ballast tank includes a rigid ballast tank body, and at least two apertures in the ballast tank body. A connector releasably connects the ballast tank to one of the hull and the deck. A pump fluidly communicates with one of the at least two apertures in the ballast tank body. A ballast tank having a generally L-shaped rigid ballast tank body is also disclosed.

23 Claims, 9 Drawing Sheets

U.S. PATENT DOCUMENTS

| | | | | |
|---|---|---|---|---|
| 6,105,527 | A | 8/2000 | Lochtefeld et al. | |
| 6,427,616 | B1 * | 8/2002 | Hagen | 114/125 |
| 6,505,572 | B1 | 1/2003 | Seipel et al. | |
| 6,941,884 | B2 | 9/2005 | Moore | |
| 6,953,002 | B2 | 10/2005 | Jessen et al. | |
| 7,013,829 | B1 | 3/2006 | Alexander | |
| 7,029,340 | B2 | 4/2006 | Smith | |
| 7,128,014 | B2 | 10/2006 | Berthiaume et al. | |
| 7,178,474 | B2 | 2/2007 | Warnes | |

FOREIGN PATENT DOCUMENTS

| | | |
|---|---|---|
| JP | 1212691 | 8/1989 |
| JP | 2262492 | 10/1990 |
| JP | 2006168693 | 4/2008 |

OTHER PUBLICATIONS

English Abstract of Japanese publication No. JP1212691.
English Abstract of Japanese publication No. JP2006168693.

* cited by examiner

PERSONAL WATERCRAFT BALLAST

FIELD OF THE INVENTION

The present invention relates to a personal watercraft having at least one ballast tank and a ballast tank for personal watercraft.

BACKGROUND OF THE INVENTION

Over the years, personal watercraft (PWC) have evolved to become larger and more powerful. The additional power means that they can easily tow a person practicing a nautical sport such as wakeboarding or water skiing. Some PWC can now accommodate three riders or more. This means that there is enough room on the PWC for a driver, a wakeboarder/waterskier, and a spotter for watching the wakeboarder/waterskier when this person is being towed behind the PWC.

In order to make PWC better suited for wakeboarding and waterskiing, some PWC now include features specifically designed for these sports. Some PWC now have racks to hold the wakeboard or water skis when not in use, as in U.S. Pat. No. 6,189,753, issued Feb. 20, 2001, the entirety of which is incorporated herein by reference. Some PWC have tow poles which provide a higher attachment point for a tow rope than the tow hooks typically found on PWC, as in U.S. Pat. No. 7,128,014, issued Oct. 31, 2006, the entirety of which is incorporated herein by reference. The higher attachment point makes aerial manoeuvres easier to perform for the wakeboarder/waterskier.

One important aspect of wakeboarding and waterskiing is the shape and size of the wake generated by the watercraft pulling the wakeboarder/waterskier (i.e. the track of waves left by the watercraft). The wakeboarder/waterskier uses the wake as a ramp to launch himself/herself in the air to perform aerial manoeuvres. The quality of the wakes generated by PWC is usually lower than that of the wakes generated by boats due to the smaller hulls and lighter weight of PWC.

To improve the quality of their wakes, many boats use a system of ballasts disposed inside the boat to increase the weight of the boat when the boat is used for wakeboarding/waterskiing. This has the advantage of not permanently increasing the weight of the boat. One such system is described in U.S. Pat. No. 6,044,788, issued Apr. 4, 2000. However, PWC do not have sufficient room between their hull and deck to accommodate such systems.

Another solution consists of adding a ballast tank somewhere on the deck of the watercraft, such as the container described in U.S. Pat. No. 5,787,835. However, when installed on a PWC, most of these take up a substantial amount of room on the deck, thus making reboarding the PWC from the water difficult. Also, securely fastening these to the PWC to prevent movement of the tanks can prove difficult and inconvenient.

Therefore, there is a need for a system or device for improving the wake generated by PWC.

SUMMARY OF THE INVENTION

It is an object of the present invention to ameliorate at least some of the inconveniences present in the prior art.

It is also an object of the present invention to provide a personal watercraft having a rear platform and a ballast tank disposed on the rear platform.

It is another object of the present invention to provide a generally L-shaped ballast tank for use on a personal watercraft.

In one aspect, the invention provides a personal watercraft having a hull and a deck disposed on the hull. The deck includes a pedestal, a first gunnel disposed on a first side of the pedestal, a first footrest disposed between the pedestal and the first gunnel, a second gunnel disposed on a second side of the pedestal, a second footrest disposed between the pedestal and the second gunnel, and a rear platform disposed at least in part rearwardly of the pedestal. The rear platform is connected to the first and second footrests. A straddle-type seat is disposed on the pedestal. A steering assembly is disposed at least in part forwardly of the seat. An engine is supported by the hull. A propulsion system is connected to the hull and is operatively connected to the engine. A ballast tank is disposed at least in part on the rear platform. The ballast tank has a first portion disposed on one of the first and second footrests laterally between the pedestal and a corresponding one of the first and second gunnels. The ballast tank includes a rigid ballast tank body, and at least two apertures in the ballast tank body. A connector releasably connects the ballast tank to one of the hull and the deck. A pump fluidly communicates with one of the at least two apertures in the ballast tank body.

In a further aspect, a second portion of the ballast tank extends behind the pedestal such that the ballast tank is generally L-shaped.

In an additional aspect, the first portion of the ballast tank abuts the pedestal and the corresponding one of the first and second gunnels, and the second portion of the ballast tank abuts the pedestal.

In a further aspect, the ballast tank is a first ballast tank. The first portion of the first ballast tank is disposed on the first footrest laterally between the pedestal and the first gunnel. A second ballast tank is disposed at least in part on the rear platform. The second ballast tank has a first portion disposed on the second footrest laterally between the pedestal and the second gunnel. The second ballast tank includes a rigid ballast tank body, and at least two apertures in the ballast tank body. A connector releasably connects the second ballast tank to one of the hull and the deck. The pump fluidly communicates with one of the at least two apertures in the ballast tank body of the second ballast tank. The first ballast tank abuts the second ballast tank.

In an additional aspect, a stopper is connected to the corresponding one of the first and the second gunnel vertically above the first portion of the ballast tank.

In a further aspect, the deck also includes a generally forwardly facing portion. The ballast tank abuts the generally forwardly facing portion.

In an additional aspect, a heel rest is disposed on the rear platform. The heel rest includes the generally forwardly facing portion of the deck. The ballast tank body has a recess abutting the forwardly facing portion.

In a further aspect, the at least two apertures in the ballast tank body includes a water inlet, and at least one water outlet. The pump fluidly communicates with the water inlet.

In an additional aspect, a drain plug is provided for selectively plugging the at least one water outlet.

In a further aspect, the at least one water outlet is at least one overflow aperture disposed in an upper portion of the ballast tank body.

In an additional aspect, a drain aperture is disposed in a lower portion of the ballast tank body, and a drain plug is provided for selectively plugging the drain aperture.

In a further aspect, the pump is a jet pump forming part of the propulsion system. A hose fluidly communicates the jet pump with the one of the at least two apertures in the ballast tank body.

In an additional aspect, the hull has an outwardly extending lip at an upper end thereof. The connector is attached to the ballast tank body. The connector includes a hook. The hook selectively hooks the lip of the hull to releasably connect the ballast tank to the hull.

In a further aspect, the ballast tank further includes a heel rest formed in an upper portion of the ballast tank body.

In an additional aspect, the ballast tank body has a generally planar upper surface and includes at least one of: carpeting bonded to the upper surface of the ballast tank body, and texturing integrally formed in the upper surface.

In a further aspect, a tow pole is connected to the deck.

In an additional aspect, the ballast tank abuts the deck such that the deck prevents movement of the ballast tank in at least three of a forward direction, a rearward direction, a left direction, and a right direction.

In another aspect, the invention provides a personal watercraft having a hull, and a deck disposed on the hull. The deck includes a pedestal, a first gunnel disposed on a first side of the pedestal, a first footrest disposed between the pedestal and the first gunnel, a second gunnel disposed on a second side of the pedestal, a second footrest disposed between the pedestal and the second gunnel, and a rear platform disposed at least in part rearwardly of the pedestal. The rear platform is connected to the first and second footrests. A straddle-type seat is disposed on the pedestal. A steering assembly is disposed at least in part forwardly of the seat. An engine is supported by the hull. A propulsion system is connected to the hull and is operatively connected to the engine. A ballast tank is disposed at least in part on the rear platform. The ballast tank abuts a rear portion of the pedestal and at least one of the first and second gunnels. The ballast tank includes a rigid ballast tank body, and at least two apertures in the ballast tank body. A connector releasably connects the ballast tank to one of the hull and the deck. A pump fluidly communicates with one of the at least two apertures in the ballast tank body.

In a further aspect, the ballast tank is a first ballast tank abutting the rear portion of the pedestal and the first gunnel. A second ballast tank is disposed at least in part on the rear platform. The second ballast tank abuts the rear portion of the pedestal and the second gunnel. The second ballast tank includes a rigid ballast tank body, and at least two apertures in the ballast tank body. A connector releasably connects the second ballast tank to one of the hull and the deck. The pump fluidly communicates with one of the at least two apertures in the ballast tank body of the second ballast tank. The first ballast tank abuts the second ballast tank.

In an additional aspect, the at least two apertures in the ballast tank body includes a water inlet, and at least one water outlet. The pump fluidly communicates with the water inlet.

In a further aspect, the at least one water outlet is at least one overflow aperture disposed in an upper portion of the ballast tank body. A drain aperture is disposed in a lower portion of the ballast tank body. A drain plug is provided for selectively plugging the drain aperture.

In an additional aspect, a tow pole is connected to the deck.

In a further aspect, the ballast tank abuts the deck such that the deck prevents movement of the ballast tank in at least three of a forward direction, a rearward direction, a left direction, and a right direction.

In yet another aspect, the invention provides ballast tank having a generally L-shaped rigid ballast tank body, a water inlet in the ballast tank body, at least one overflow aperture in the ballast tank body, and a connector attached to the ballast tank body for releasably connecting the ballast tank to one of a hull and a deck of a personal watercraft.

In an additional aspect, a drain aperture disposed in the ballast tank body, and a drain plug is provided for selectively plugging the drain aperture.

In a further aspect, a hose is connected to the water inlet.

For purposes of this application, terms related to spatial orientation such as forwardly, rearwardly, left, and right, are as they would normally be understood by a driver of the watercraft sitting thereon in a normal driving position. It should be understood that terms related to spatial orientation when referring to the ballast tank alone, such as "upper portion" and "lower portion" should be understood as they would normally be understood when the ballast tank is installed on a watercraft.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The following description relates to one possible way of manufacturing a personal watercraft (PWC). Obviously, those of ordinary skill in the watercraft art will recognize that there are other known ways of manufacturing and designing watercraft.

Figure 1:
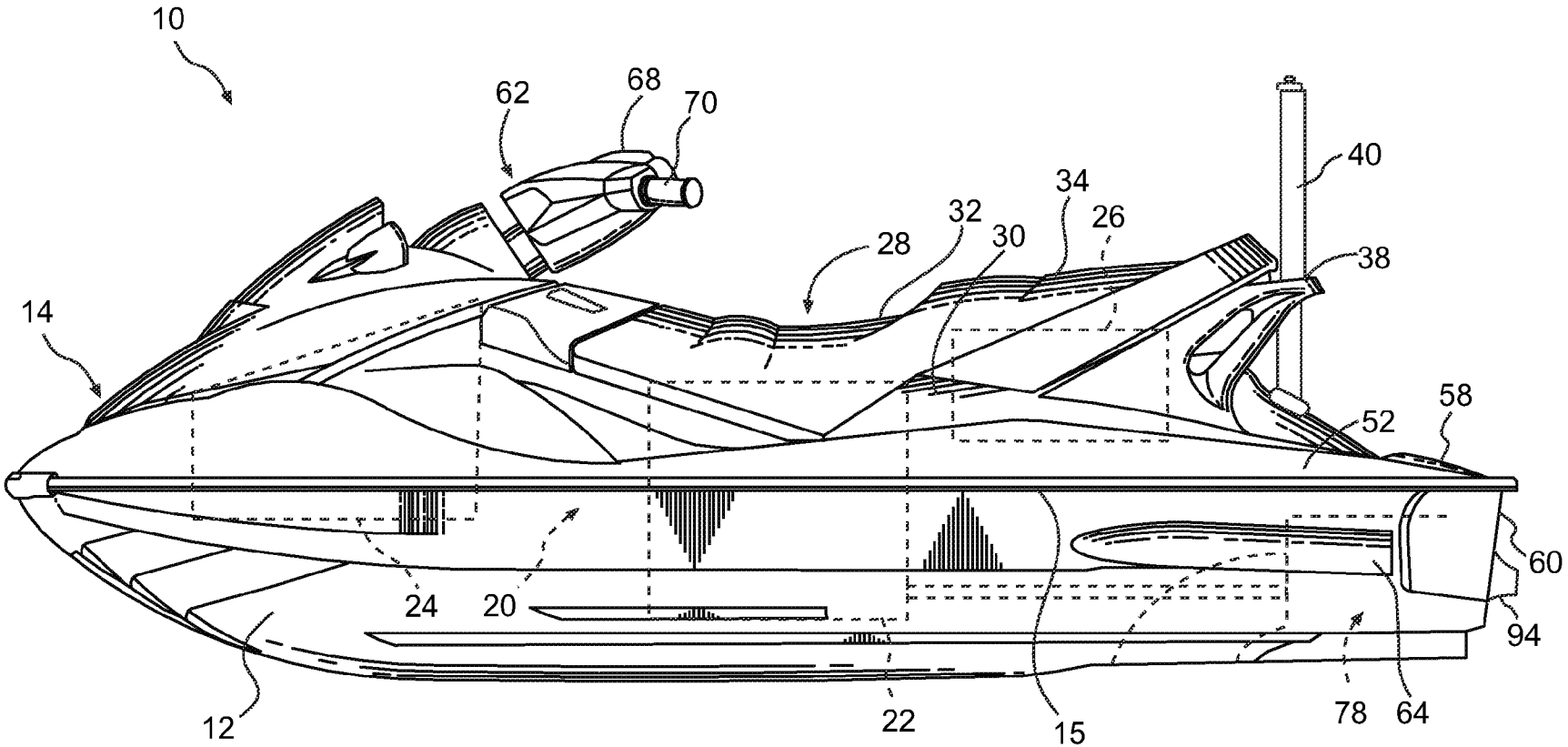
FIG. 1 is a left side view of a personal watercraft (PWC) having a tow pole.
Figure 3:
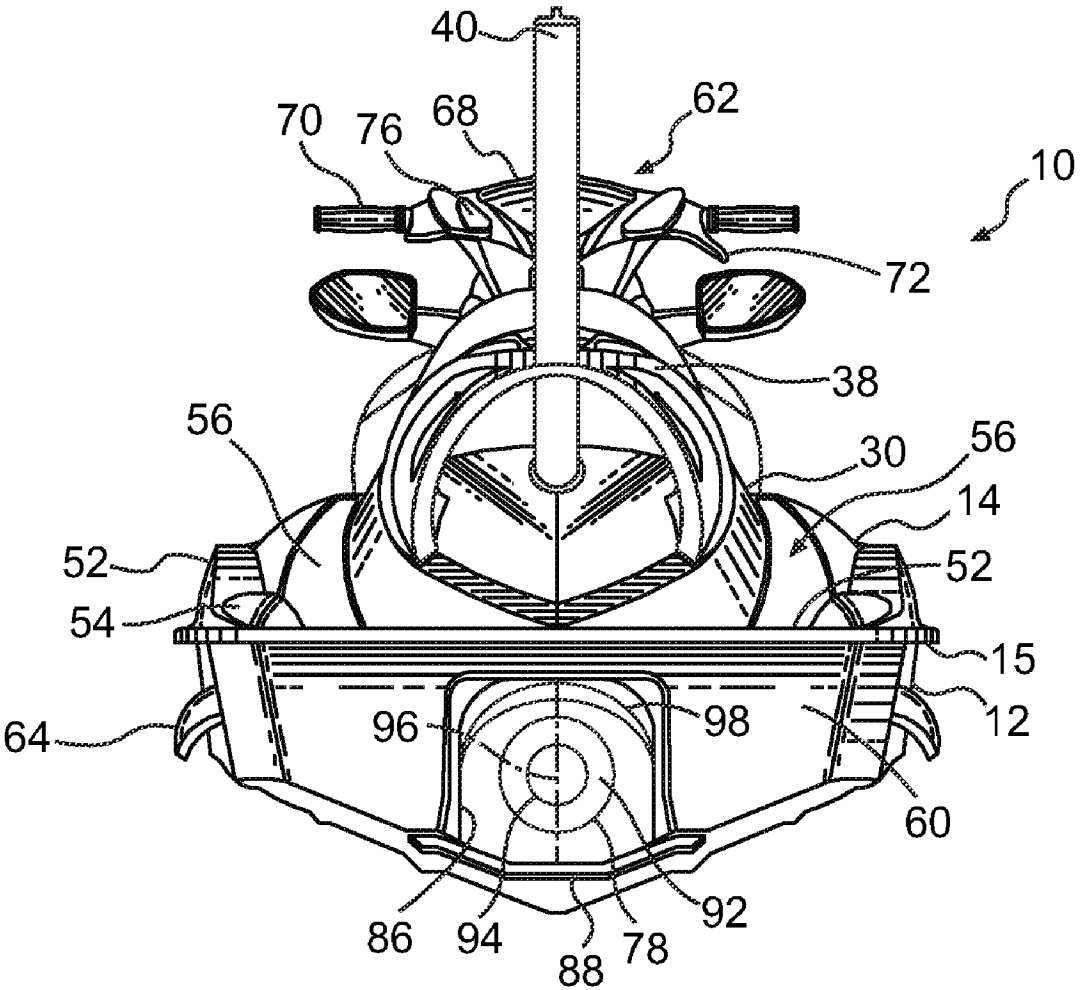
FIG. 3 is a rear view of the PWC of FIG. 1.
Figure 4:
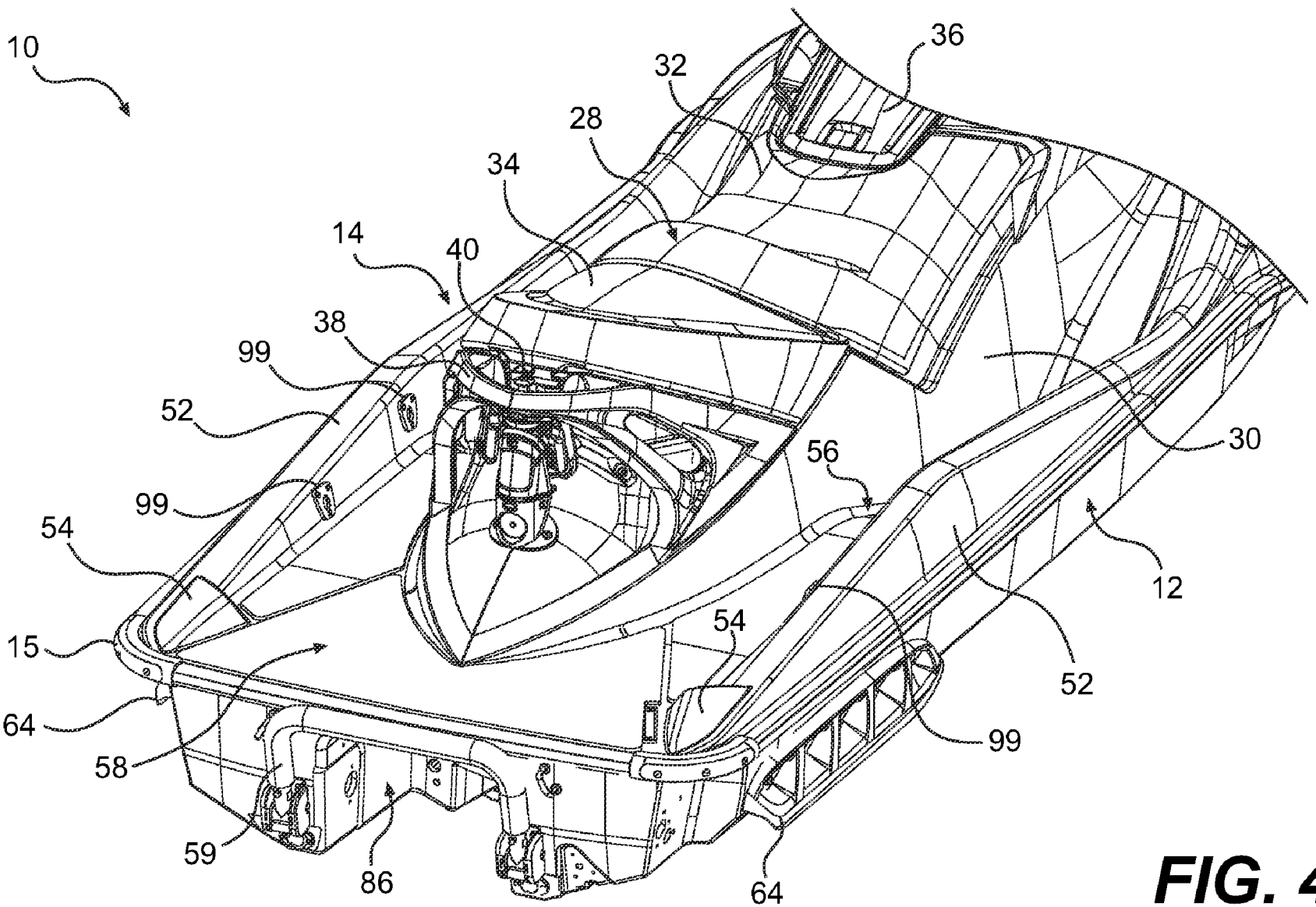
FIG. 4 is a perspective view, taken from a rear, right side, of a portion of the PWC of FIG. 1 having an alternative embodiment of a tow pole.
Figure 5:
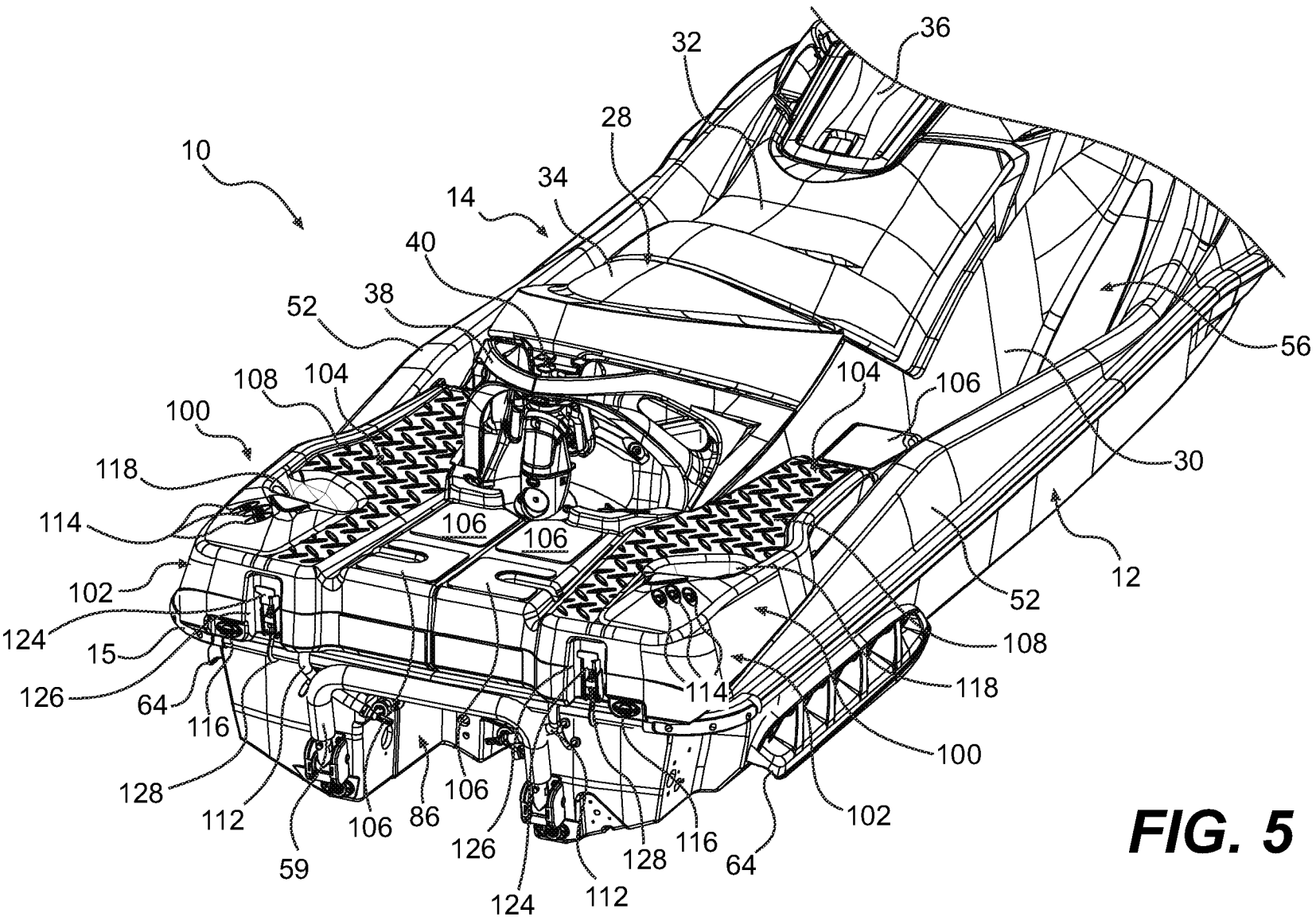
FIG. 5 is a perspective view, taken from a rear, right side, of the portion of the PWC of FIG. 4 with ballast tanks.

The PWC 10 of FIG. 1 is made of a hull 12 and a deck 14 disposed on the hull 12. The hull 12 buoyantly supports the PWC 10 in the water. The deck 14 is designed to accommodate a rider and at least one passenger. As best seen in FIGS. 3 to 5, the upper part of the hull 12 has an outwardly extending lip 15. The lower part of the deck 14 has a corresponding outwardly extending lip (not labelled) which is bonded or otherwise fastened to the lip 15 of the hull 12.

The space between the hull 12 and the deck 14 forms a volume commonly referred to as the engine compartment 20. Shown schematically in FIG. 1, the engine compartment 20 accommodates an engine 22, as well as intake, exhaust, fuel, and electrical systems, storage bins 24, 26, and other elements required or desirable in the PWC 10. The engine 22 is supported in the hull 12 by a plurality of engine mounts (not shown)

Figure 2:
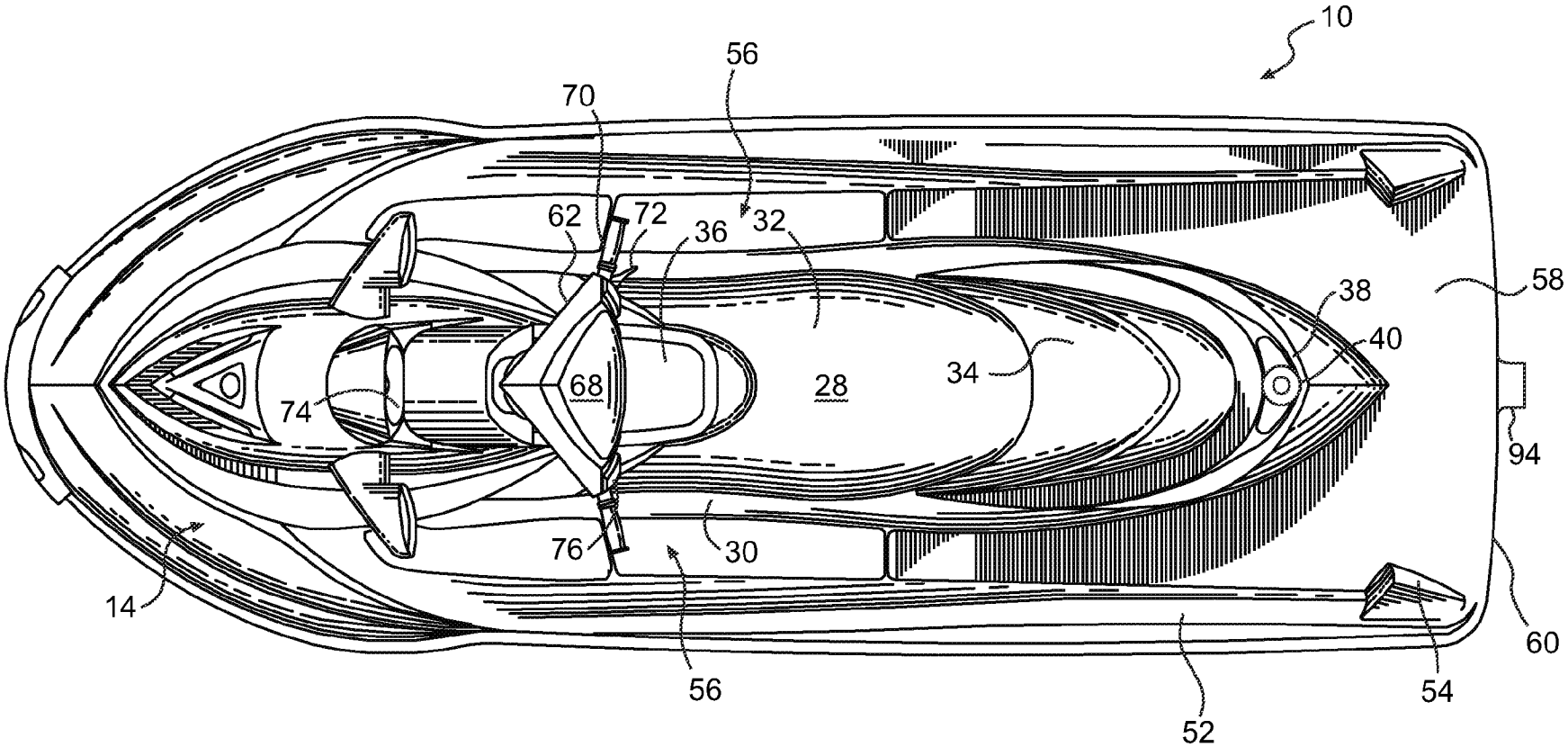
FIG. 2 is a top view of the PWC of FIG. 1.

As seen in FIGS. 1 and 2, the deck 14 has a centrally positioned straddle-type seat 28 positioned on top of a pedestal 30 to accommodate riders in a straddling position. The seat 28 is sized to accommodate multiple riders. As seen in FIG. 2, the seat 28 includes a first, front seat portion 32 and a rear, raised seat portion 34. The seat portions 32, 34 can be individually tilted or removed completely. The seat portion 32 covers an engine access opening (in this case above engine 22), defined by a top portion of the pedestal 30, to provide access to the engine 22 (FIG. 1). The other seat portion 34 covers a removable storage box 26 (FIG. 1). A small storage box 36 (FIG. 2) is provided in front of the seat 28.

As best seen in FIGS. 2 and 3, the PWC 10 has a pair of generally upwardly extending walls known as gunwales or gunnels 52 located on either side of the PWC 10. Towards the rear of the PWC 10, the gunnels 52 extend inwardly to act as heel rests 54. The heel rests 54 have a generally forwardly facing portion which support a passenger's feet when the passenger is riding the PWC 10 facing towards the rear. Located on both sides of the PWC 10, between the pedestal 30 and the gunnels 52 are footrests 56, which accommodate a rider's feet in various riding positions.

The deck has a rear platform 58 provided at the rear of the PWC 10 in part rearwardly of the pedestal 30 to allow the rider or a passenger to easily reboard the PWC 10 from the water. As can be seen in FIG. 3, the rear platform 58 is connected to the footrests 56. Carpeting or some other suitable covering covers portions of the rear platform 58. A retractable ladder 59 (shown in FIGS. 4 to 7) is affixed to a stern 60 to facilitate boarding the PWC 10 from the water onto the rear platform 58.

Sponsons 64 are located on both sides of the hull 12 near the stern 60. The sponsons 64 have arcuate undersurfaces that give the PWC 10 both lift while in motion and improved turning characteristics. The sponsons 64 are fixed to the surface of the hull 12 and are attached to the hull 12 by fasteners.

A steering assembly 62 is disposed in part forwardly of the seat 28. The steering assembly has a central helm portion 68 and a pair of steering handles 70. It is contemplated that any other type of steering assembly could be used, such as a steering wheel. One of the steering handles 70 is provided with a throttle lever 72 which allows the rider to control the speed of the PWC 10. As seen in FIG. 2, a display area or cluster 74 is located forwardly of the steering assembly 62. The central helm portion 68 has various buttons 76 that allow the rider to modify the display data or mode (speed, engine rpm, time . . . ) on the display cluster 74 or to change a condition of the PWC 10, such as trim (the pitch of the PWC 10).

As shown in FIGS. 1 and 3, the PWC 10 has a propulsion system which includes a jet pump 78 operatively connected to the engine 22. It is contemplated that other types of propulsion systems, such as systems using propellers, could be used. The jet pump 78 pressurizes water to create thrust. The jet pump 78 is connected to and is located in a formation in the hull 12, referred to as a tunnel 86. The tunnel 86 is defined at the front, sides, and top by the hull 12 and is open at the stern 60. The bottom of the tunnel 86 is closed by a ride plate 88. The ride plate 88 creates a surface on which the PWC 10 rides or planes at high speeds.

Once the water leaves the jet pump 78, it goes through a venturi 92. Since the exit diameter of the venturi 92 is smaller than its entrance diameter, the water is accelerated further, thereby providing more thrust. A steering nozzle 94 is pivotally attached to the venturi 92 so as to rotate about a vertical axis 96. The steering nozzle 94 could also be supported at the exit of the tunnel 86 in other ways without a direct connection to the venturi 92. Moreover, the steering nozzle 94 could be replaced by a rudder or other diverting mechanism disposed at the exit of the ventur 92 to selectively direct the thrust generated by the jet propulsion system 78 to effect turning. Alternatively, rudders or other diverting mechanisms could be mounted to the stern 60 or other portion of the hull 12 to steer the PWC 10. The steering nozzle 94 is operatively connected to the steering assembly 62 preferably via a push-pull cable (not shown) such that when the steering assembly 62 is turned, the steering nozzle 94 pivots. This movement redirects the pressurized water coming from the venturi 92, so as to redirect the thrust and steer the PWC 10 in the desired direction. Optionally, the steering nozzle 94 may be gimbaled to allow it to move around a second horizontal pivot axis (not shown). The up and down movement of the steering nozzle 94 provided by this additional pivot axis is known as trim and controls the pitch of the PWC 10.

When the PWC 10 is moving, its speed is measured by a speed sensor (not shown) that is typically attached to the stern 60 of the PWC 10. The speed sensor has a paddle wheel that is turned by the water flowing past the hull 12. In operation, as the PWC 10 goes faster, the paddle wheel turns faster in correspondence. An electronic control unit (ECU) (not shown) is connected to the speed sensor and converts the rotational speed of the paddle wheel to the speed of the PWC 10 in kilometres or miles per hour, depending on the rider's preference. The speed sensor may also be placed in the ride plate 88 or at any other suitable position. Other types of speed sensors, such as pitot tubes, and processing units could be used, as would be readily recognized by one of ordinary skill in the art.

The PWC 10 is provided with a reverse gate 98 (FIG. 3) which allows it to move in a reverse direction. The reverse gate 98 is pivotally attached to the sidewalls of the tunnel 86, or alternatively directly on the venturi 92 or the steering nozzle 94.

As seen in FIG. 3, a grab handle 38 is provided between the pedestal 30 and the rear of the seat 28 to provide a handle onto which a passenger may hold. This arrangement is particularly convenient for a passenger seated facing backwards for spotting a wakeboarder, for example. Beneath the handle 38, a tow pole 40, also commonly referred to as a pylori, is mounted on the deck 14, more specifically on the pedestal 30 such that it extends through the handle 38 and above the level of the seat 28. It is contemplated the that the tow pole 40 could be mounted directly on the rear platform 58 of the deck 14.

Alternatively, the tow pole 40 may not extend through the handle 38, but may instead be mounted such that it extends from the deck 14 rearwardly of the handle 38. The tow pole 40 may be telescopic so that it can be stored in a non-extended position as seen in FIGS. 4 and 5. Also, the tow pole 40 may include handles onto which a passenger may hold when the passenger is facing backwards. The tow pole 40 can be used for towing a wakeboarder, a waterskier, or a floatation device, such as an inflatable water toy.

Figure 6:
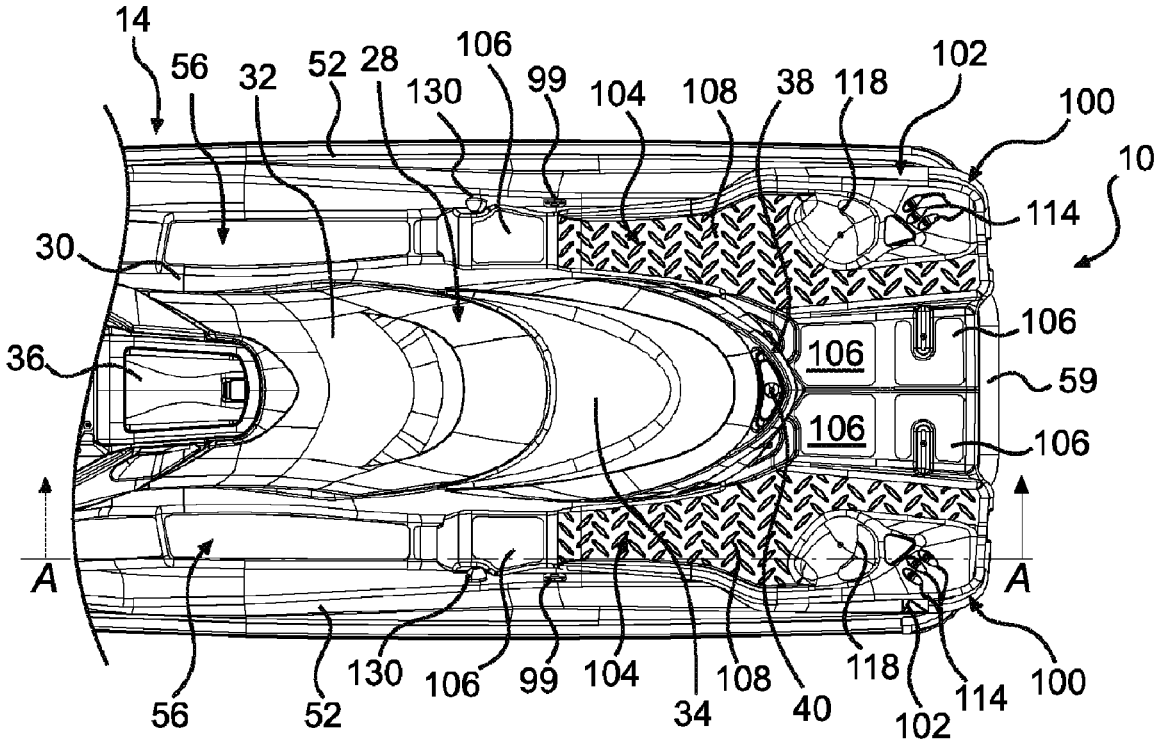
FIG. 6 is a top view of the portion of the PWC of FIG. 5.
Figure 7:
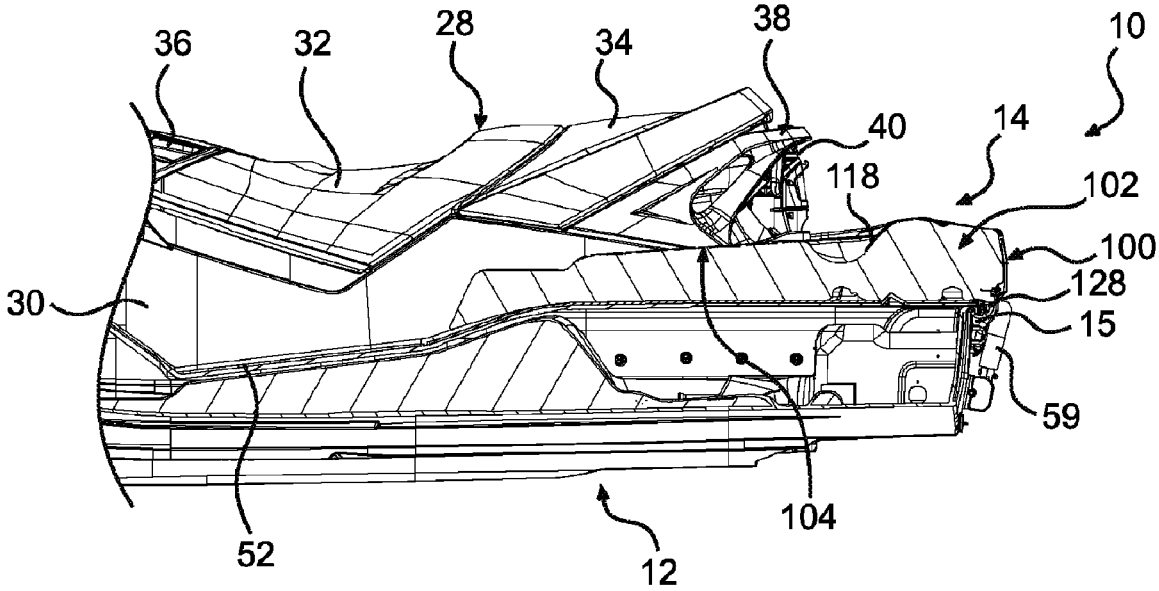
FIG. 7 is a partial cross-section of the portion of the PWC of FIG. 5 taken through line A-A of FIG. 6.

As seen in FIGS. 4 and 6, the PWC 10 is also provided with anchor bases 99 on the gunnels 52 which permit the attachment of a rack for holding a wakeboard or water skis, such as the one shown in U.S. Pat. No. 6,189,753.

The PWC 10 is provided with a pair of removable ballast tanks 100. As described in greater detail below, the ballast tanks 100, when in use, are disposed on the rear platform 58 and can be filled with water to increase the weight at the back of the PWC 10, thus improving the quality of the wake generated by the PWC 10. When not in use, water is drained from the ballast tanks 100 and they can be removed from the PWC 10.

Figure 8:
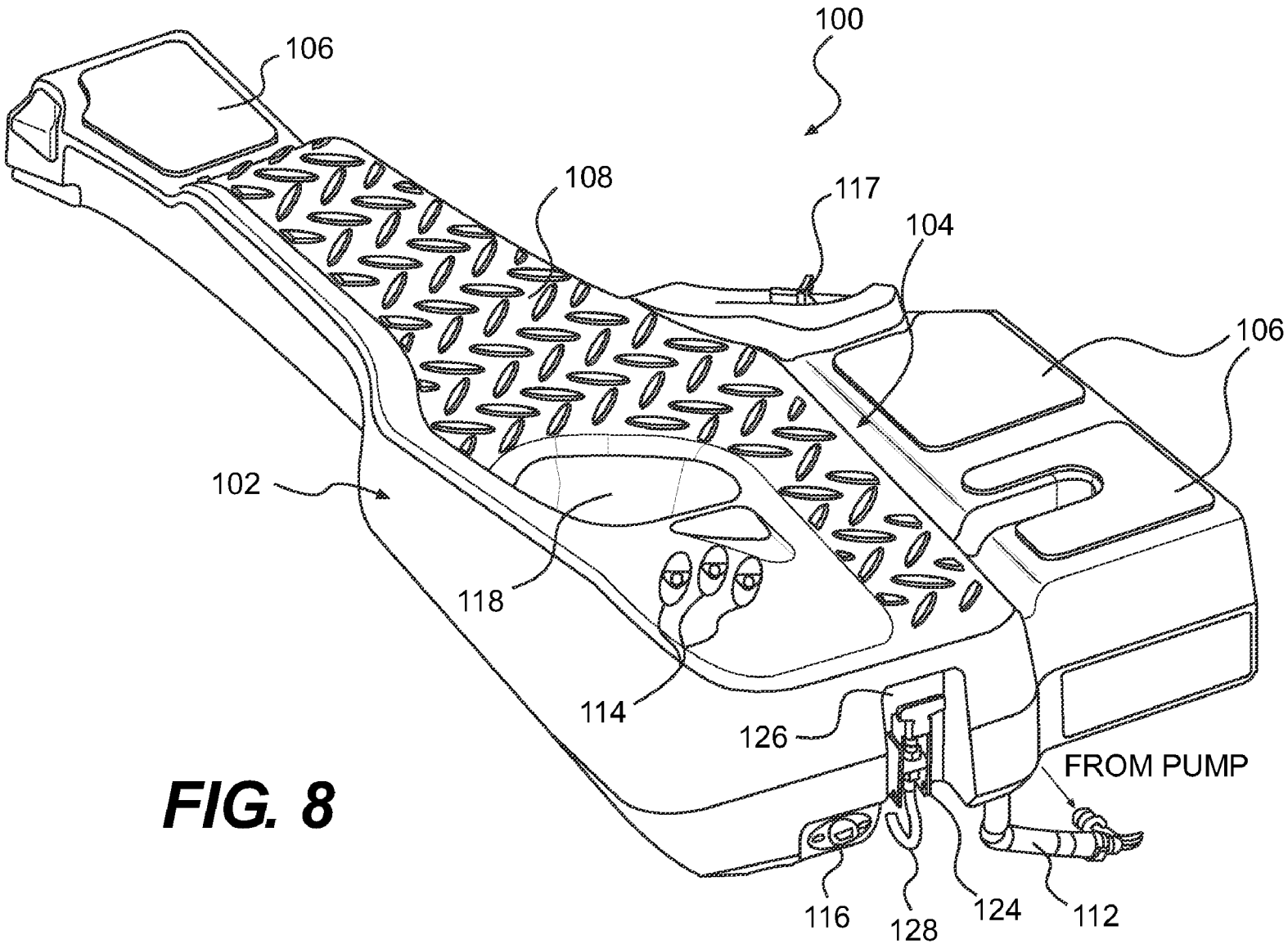
FIG. 8 is a top perspective view, taken from a rear, left side, of the left ballast tank shown in FIG. 5.
Figure 9:
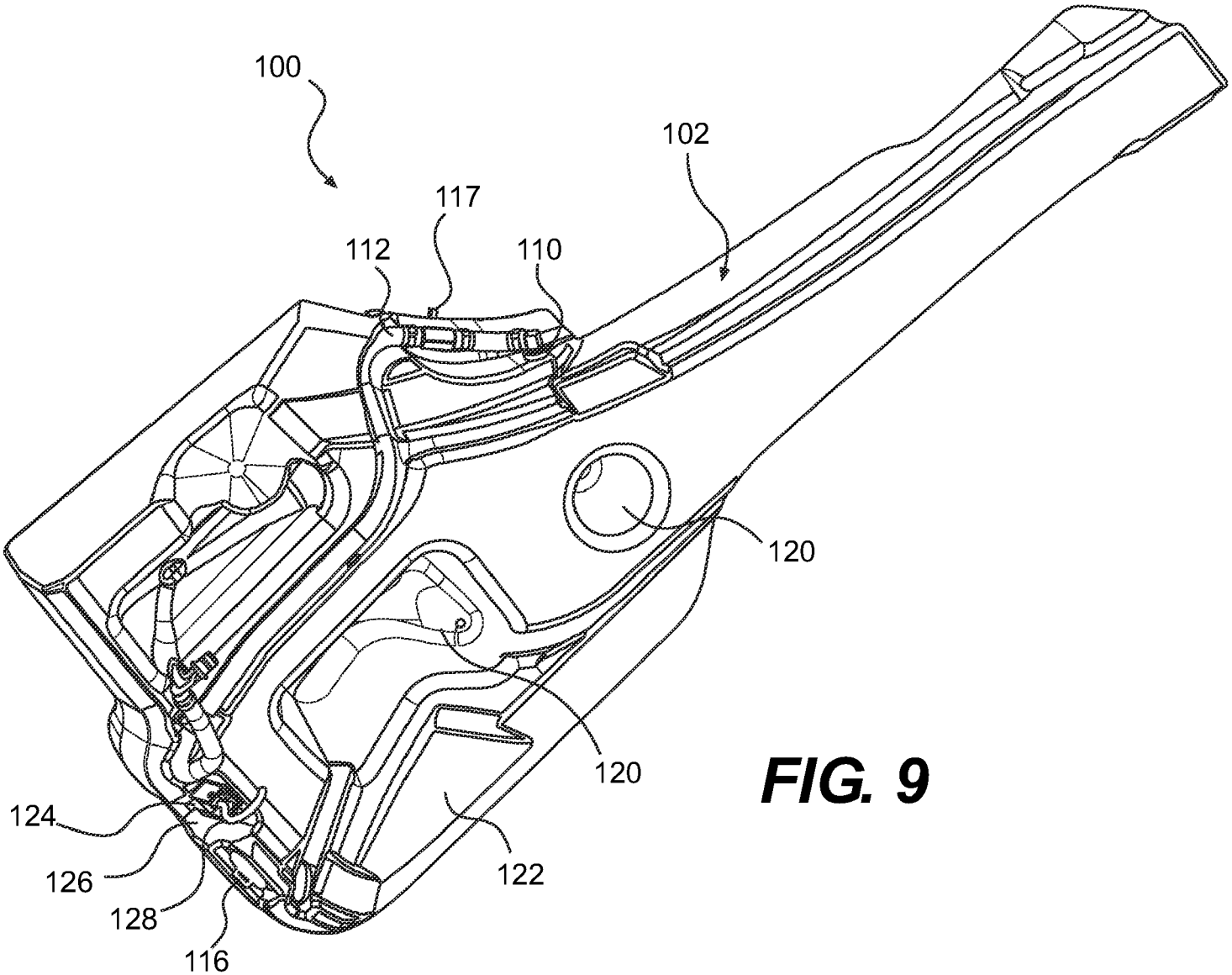
FIG. 9 is a bottom perspective view, taken from a rear, right side, of the ballast tank of FIG. 8.

Turning now to FIGS. 8 and 9, the left ballast tank 100 will be described. The right ballast tank 100 will not be described in detail since it is a mirror image of the left ballast tank 100. The ballast tank 100 has a ballast tank body 102 defining a volume for containing water. As can be seen, the ballast tank body 102 is generally L-shaped. The ballast tank body 102 is made of a rigid material, such as blow molded plastic. The ballast tank body 102 has a generally planar upper surface 104. The planar upper surface 104 and the rigid material used for making the ballast tank body 102 make it possible for a rider of the PWC 10 to step on the ballast tank body 102 when the ballast tank 100 is installed on the PWC 10. Carpeting 106 is bonded to portions of the upper surface 104. Another portion of the upper surface 104 has texturing 108 integrally formed with the ballast tank body 102. Both the carpeting 106 and texturing 108 help increase the traction on the upper surface 104 of the ballast tank body 102. It is contemplated that only one of carpeting 106 and texturing 108 could be used on the upper surface 104.

The ballast tank body 102 has a water inlet 110 on a side thereof for filling the ballast tank body 102, as described below. A hose 112 connects the water inlet 110 to the jet pump 78. A portion of the hose 112 is disposed in a recess in the bottom of the ballast tank body 102 to prevent it from becoming flattened between the ballast tank body 102 and the rear platform 58 when the ballast tank 100 is installed on the PWC 10. The connection between the hose 112 and the jet pump 78 can preferably be made without the use of tools such that the ballast tank 100 can be easily installed onto and removed from the PWC 10. It is contemplated that the hose 112 could alternatively be connected to an electrical or mechanical water pump for pumping water from the body of water into which the PWC 10 operates to the ballast tank body 102.

The ballast tank body 102 has four water outlets. Three of the water outlets are overflow apertures 114 located on the upper surface 104. It is contemplated that the overflow apertures 114 could alternatively be located on the sides of the ballast tank body 102 near the upper portion thereof. The other water outlet is a drain aperture (not labelled) located on the rear side of the ballast tank body 102 near the lower portion thereof. The drain aperture is selectively plugged by a drain plug 116. It is contemplated that the number and position of overflow apertures 114 and drain apertures/plugs 116 could be different from what is described above.

When the PWC 10 is operated with the ballast tank 100 installed on the rear platform 58 of the PWC 10, as described in greater detail below, and the hose 112 connected to the jet pump 78, water from the jet pump 78 fills the ballast tank body 102. The jet pump 78 continuously pumps water inside the ballast tank body 102. Once water inside the ballast tank body 102 reaches the level of the overflow apertures 114, water exits the ballast tank body 102 through the overflow apertures 114, thus preventing pressure build-up inside the ballast tank body 102. The weight of the water inside the two ballast tanks 100 increases the weight at the back of the PWC 10 which improves the quality of the wake generated by the PWC 10. To empty the water from the ballast tank body 102, the drain plug 116 is removed from the drain aperture, thus allowing water to drain therethrough.

When the ballast tank 100 is installed, but the users of the PWC 10 do not want the ballast tank body 102 to fill up with water, a valve 117 provided on the upper surface 104 of the ballast tank body 102 is closed thus preventing the supply of water from the hose 112 to the inside of the ballast tank body 102. Alternatively, the drain plug 116 can be removed from the drain aperture, thereby causing water to drain from the ballast tank body 102 almost as soon as it enters the ballast tank body 102, or the hose 112 can simply be disconnected from the jet pump 78. In cases where a separate electrical or mechanical water pump is used, the pump can, obviously, simply be turned off.

FIGS. 10A to 10D illustrate various alternative embodiments of the ballast tank 100.

Figure 10A:
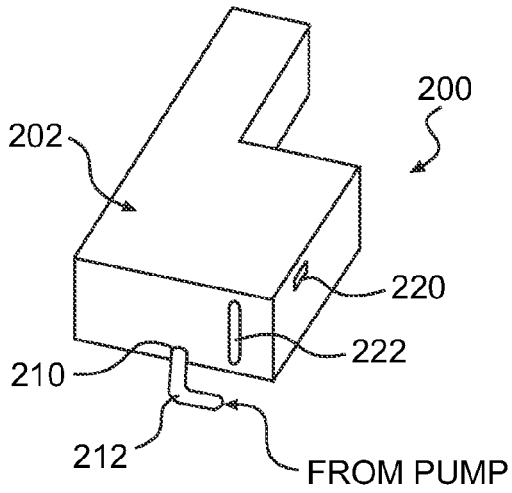
FIG. 10A is a schematic top perspective view, take from a rear, right side, of an alternative embodiment of a left ballast tank.

FIG. 10A illustrates a ballast tank 200 having a rigid ballast tank body 202. The ballast tank body 202 has a single aperture 210 for water and another aperture (not shown) to allow air to vent from the ballast tank body 202 as it is being filled with water. A hose 212 connects the aperture 210 to a water pump (the jet pump 78 or any other water pump). Since there are no overflow apertures in the ballast tank body 202, a water level sensor 220 is preferably provided in the ballast tank body 202 to send a signal to close a valve (not shown) between the aperture 210 and the water pump or to turn off the pump once the water inside the ballast tank body 202 reaches a certain level. Alternatively, a translucent window 222 on a side of the ballast tank body 202 can be provided to allow a user of the PWC 10 to see the level of water inside the ballast tank body 202 and the user can close the valve or turn off the pump once the desired water level is reached. The air vent aperture allows air to escape the ballast tank body 202 as it is being filled with water. To drain the water from the ballast tank body 202, the hose 212 can simply be disconnected from the aperture 210 or the pump.

Figure 10B:
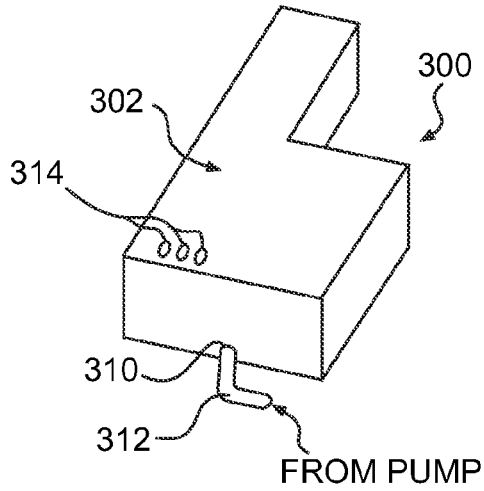
FIG. 10B is a schematic top perspective view, take from a rear, right side, of another alternative embodiment of a left ballast tank.

FIG. 10B illustrates a ballast tank 300 having a rigid ballast tank body 302. The ballast tank body 302 has an aperture 310 and three overflow apertures 314. A hose 312 connects the aperture 310 to a water pump (the jet pump 78 or any other water pump). As in the ballast tank 100, the overflow apertures 314 will allow water to exit the ballast tank body 302 when it is filled with water, thus preventing pressure build-ups inside the ballast tank body 302. As in the ballast tank 200, to drain the water from the ballast tank body 302, the hose 312 can simply be disconnected from the aperture 310 or the pump.

Figure 10C:
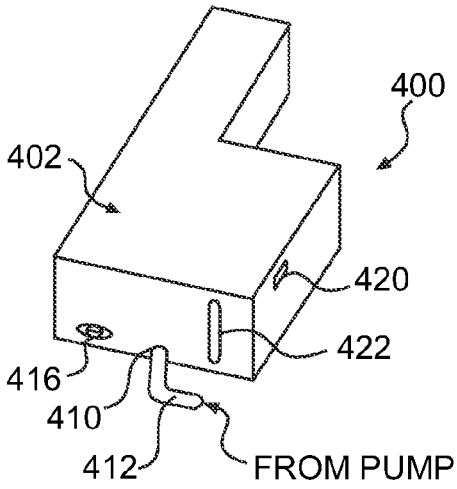
FIG. 10C is a schematic top perspective view, take from a rear, right side, of yet another alternative embodiment of a left ballast tank.

FIG. 10C illustrates a ballast tank 400 having a rigid ballast tank body 402. The ballast tank body 402 has a water inlet 410, a drain aperture with a drain plug 416, and another aperture (not shown) to allow air to vent from the ballast tank body 202 as it is being filled with water. A hose 412 connects the water inlet 410 to a water pump (the jet pump 78 or any other water pump). Since there are no overflow apertures in the ballast tank body 402, a water level sensor 420 or a translucent window 422 is provided in order to prevent over-filling the ballast tank body 402. The air vent apertures allows air to escape the ballast tank body 402 as it is being filled with water. To drain the water from the ballast tank body 402, the drain plug 416 can simply be removed from the drain aperture.

Figure 10D:
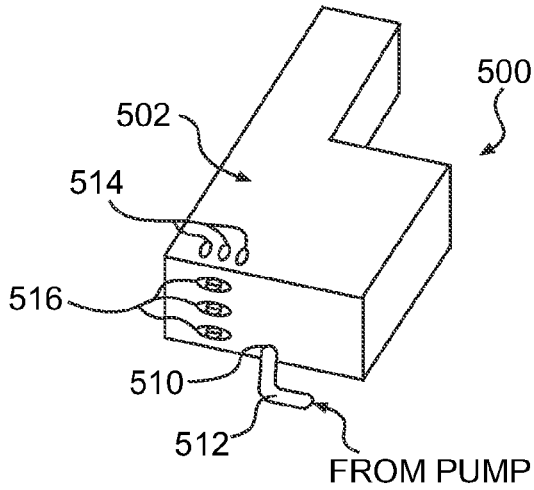
FIG. 10D is a schematic top perspective view, take from a rear, right side, of another alternative embodiment of a left ballast tank.

FIG. 10D illustrates a ballast tank 500 having a rigid ballast tank body 502. The ballast tank body 502 has a water inlet 510, three overflow apertures 514, and three drain aperture with corresponding drain plugs 516. A hose 512 connects the water inlet 510 to a water pump (the jet pump 78 or any other water pump). The three drain apertures are disposed at different heights along a side of the ballast tank body 502. This allows a user of the PWC 10 to set different levels of water inside the ballast tank body 502. To completely fill the ballast tank body 502, all three drain plugs 516 are placed in their respective drain aperture, and the overflow apertures 514 will allow water to exit the ballast tank body 502 when it is filled with water, thus preventing pressure build-ups inside the ballast tank body 502. Removing the upper or middle drain plug 516 from its corresponding drain aperture will cause water to exit the drain aperture once it reaches the level of the drain aperture. The bottom drain plug 516 is removed to drain the ballast tank body 502. It is contemplated that more or fewer drain apertures and a corresponding number of plugs 516 could be provided depending on the degree of adjustment desired.

Returning to FIGS. 8 and 9, additional features of the ballast tank 100 will be described. A recess is formed in the upper surface 104 of the ballast tank body 102 to form a heel rest 118. The heel rest 118 supports a passenger's foot when the passenger is riding the PWC 10 facing towards the rear and the ballast tank 100 is installed on the rear platform 58 of the PWC 10. Two other recesses 120 are formed in the bottom of the ballast tank body 102. The recesses 120 occupy volume inside the ballast tank body 102 such that the weight of the water in the ballast tank body 102 is evenly distributed. Another recess 122 is formed in the bottom of the ballast tank body 102. The recess 122 conforms to the shape of the heel rest 54 on the deck 14 over which the ballast tank 100 is disposed when installed, as described in greater detail below. In PWC having recessed heel rests, the recess 122 in the ballast tank body 102 would be replaced by a protrusion conforming to the shape of the recessed heel rest. The ballast tank 100 is also provided with a connector 124 connected to the ballast tank body 102 in a recess 126 in a rear portion of the ballast tank body 102. The connector 124 is a latch-type connector having a hook 128, but other types of connectors are contemplated. The connector 124 is used to connect the ballast tank 100 to the hull 12 of the PWC 10 as described below. It is contemplated that the connector 124 could be used to connect the ballast tank 100 to the deck 14. It is also contemplated that the connector 124 could be disposed on the hull 12 or the deck 14 and would connect the ballast tank 100 thereto. The ballast tanks 200, 300, 400, and 500 could be provided with similar features.

Turning now to FIGS. 4 to 7, the installation and removal of the ballast tanks 100 on the PWC 10 will be described. The front portion of the left ballast tank 100 is first slid from behind the PWC 10 onto the rear portion of the left footrest 56 under a stopper 130. The stopper 130 is connected to the left gunnel 52. The rear portion of the ballast tank 100 is then lowered onto the rear platform 58. The hook 128 of the connector 124 is then hooked under the lip 15 of the hull 12 and the latch of the connector 124 closed. Finally, the hose 112 is connected to the jet pump 78. The right ballast tank 100 is installed in the same manner. The ballast tanks 200, 300, 400, and 500 would be installed in a similar manner. It is contemplated that instead of having two L-shaped ballast tanks 100, that a single U-shaped ballast tank could be used. To fill the ballast tanks 100, the drain apertures must first be plugged by drain plugs 116, the valves 117 placed in the position allowing water to flow from the hoses 112 to the inside of the ballast tank bodies 102, and the PWC 10 operated such that the jet pump 78 pumps water. To remove the ballast tanks 100 (while the PWC 10 is not operating), the ballast tanks 100 must first be drained from water by removing the drain plugs 116 from the drain apertures, and the hose 112 disconnected from the jet pump 78. The connectors 124 are then disconnected from the lip 15 of the hull 12. Finally, the rear portion of each ballast tank 100 is lifted and each ballast tank 100 pulled towards the back of the PWC 10.

When installed as described above and as shown in FIGS. 5 to 7, upward movement of the front portion of the left ballast tank 100 is limited by the left stopper 130 disposed above that portion, and upward movement of the rear portion of the left ballast tank 100 is prevented by its connector 124. The left sides of the left ballast tank 100 abuts the left gunnel 52, thereby preventing movement of the left ballast tank 100 towards the left. The right side of the front portion of the left ballast tank 100 abuts the left side of the pedestal 30 and the right side of the rear portion of the left ballast tank 100 abuts the left side of the rear portion of the right ballast tank 100, thereby preventing movement of the left ballast tank 100 towards the right. The front part of the rear portion of the left ballast tank 100 abuts the rear part of the pedestal 30, thereby preventing movement of the left ballast tank 100 towards the front. The recess 122 in the ballast tank body 102 of the left ballast tank 100 abuts the generally forwardly facing portion of the left heel rest 54, thereby preventing movement of the left ballast tank 100 towards the back. It is contemplated that other surfaces of the ballast tank body 102 could abut other generally forwardly facing surfaces of the deck 14 to prevent movement of the left ballast tank 100 towards the back. Movement of the right ballast tank 100 is similarly prevented.

In the above-described embodiment, abutment between the deck 14 and the ballast tanks 100 prevents movement of each of the ballast tanks 100 in a forward direction, a rearward direction, a left direction, and a right direction. However, it is contemplated that abutment between the deck 14 and the ballast tanks 100 could prevent movement of each of the ballast tanks 100 in only three of these four directions. Abutment between the two ballast tanks 100, the connectors 124, or additional connectors could be used to prevent movement of the ballast tanks 100 in the other direction.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A personal watercraft comprising:

a hull;

a deck disposed on the hull, the deck including:

a pedestal;

a first gunnel disposed on a first side of the pedestal;

a first footrest disposed between the pedestal and the first gunnel;

a second gunnel disposed on a second side of the pedestal;

a second footrest disposed between the pedestal and the second gunnel; and a rear platform disposed at least in part rearwardly of the pedestal, the rear platform being connected to the first and second footrests;

a straddle-type seat disposed on the pedestal;

a steering assembly disposed at least in part forwardly of the seat;

an engine supported by the hull;

a propulsion system connected to the hull and being operatively connected to the engine;

a ballast tank disposed at least in part on the rear platform, the ballast tank having a first portion disposed on one of the first and second footrests laterally between the pedestal and a corresponding one of the first and second gunnels, the ballast tank including:

a rigid ballast tank body; and at least two apertures in the ballast tank body;

a connector releasably connecting the ballast tank to one of the hull and the deck; and a pump fluidly communicating with one of the at least two apertures in the ballast tank body.

2. The personal watercraft of claim 1, wherein a second portion of the ballast tank extends behind the pedestal such that the ballast tank is generally L-shaped.

3. The personal watercraft of claim 2, wherein the first portion of the ballast tank abuts the pedestal and the corresponding one of the first and second gunnels; and wherein the second portion of the ballast tank abuts the pedestal.

4. The personal watercraft of claim 2, wherein the ballast tank is a first ballast tank;

wherein the first portion of the first ballast tank is disposed on the first footrest laterally between the pedestal and the first gunnel;

the personal watercraft further comprising:

a second ballast tank disposed at least in part on the rear platform, the second ballast tank having a first portion disposed on the second footrest laterally between the pedestal and the second gunnel, the second ballast tank including:

a rigid ballast tank body; and at least two apertures in the ballast tank body;

a connector releasably connecting the second ballast tank to one of the hull and the deck;

wherein the pump fluidly communicates with one of the at least two apertures in the ballast tank body of the second ballast tank; and wherein the first ballast tank abuts the second ballast tank.

5. The personal watercraft of claim 1, further comprising a stopper connected to the corresponding one of the first and the second gunnel vertically above the first portion of the ballast tank.

6. The personal watercraft of claim 1, wherein the deck further includes a generally forwardly facing portion; and wherein the ballast tank abuts the generally forwardly facing portion.

7. The personal watercraft of claim 6, further comprising a heel rest disposed on the rear platform;

wherein the heel rest includes the generally forwardly facing portion of the deck; and wherein the ballast tank body has a recess abutting the forwardly facing portion.

8. The personal watercraft of claim 1, wherein the at least two apertures in the ballast tank body includes:

a water inlet; and at least one water outlet; and wherein the pump fluidly communicates with the water inlet.

9. The personal watercraft of claim 8, further comprising a drain plug for selectively plugging the at least one water outlet.

10. The personal watercraft of claim 8, wherein the at least one water outlet is at least one overflow aperture disposed in an upper portion of the ballast tank body.

11. The personal watercraft of claim 10, further comprising:

a drain aperture disposed in a lower portion of the ballast tank body; and a drain plug for selectively plugging the drain aperture.

12. The personal watercraft of claim 1, wherein the pump is a jet pump forming part of the propulsion system; and further comprising a hose fluidly communicating the jet pump with the one of the at least two apertures in the ballast tank body.

13. The personal watercraft of claim 1, wherein the hull has an outwardly extending lip at an upper end thereof; and wherein the connector is attached to the ballast tank body, the connector including a hook, the hook selectively hooking the lip of the hull to releasably connect the ballast tank to the hull.

14. The personal watercraft of claim 1, wherein the ballast tank further includes a heel rest formed in an upper portion of the ballast tank body.

15. The personal watercraft of claim 1, wherein the ballast tank body has a generally planar upper surface and includes at least one of:

carpeting bonded to the upper surface of the ballast tank body; and texturing integrally formed in the upper surface.

16. The personal watercraft of claim 1, further comprising a tow pole connected to the deck.

17. The personal watercraft of claim 1, wherein the ballast tank abuts the deck such that the deck prevents movement of the ballast tank in at least three of a forward direction, a rearward direction, a left direction, and a right direction.

18. A personal watercraft comprising:

a hull;

a deck disposed on the hull, the deck including:

a pedestal;

a first gunnel disposed on a first side of the pedestal;

a first footrest disposed between the pedestal and the first gunnel;

a second gunnel disposed on a second side of the pedestal;

a second footrest disposed between the pedestal and the second gunnel; and a rear platform disposed at least in part rearwardly of the pedestal, the rear platform being connected to the first and second footrests;

a straddle-type seat disposed on the pedestal;

a steering assembly disposed at least in part forwardly of the seat;

an engine supported by the hull;

a propulsion system connected to the hull and being operatively connected to the engine;

a ballast tank disposed at least in part on the rear platform, the ballast tank abutting a rear portion of the pedestal and at least one of the first and second gunnels, the ballast tank including:

a rigid ballast tank body; and at least two apertures in the ballast tank body;

a connector releasably connecting the ballast tank to one of the hull and the deck; and a pump fluidly communicating with one of the at least two apertures in the ballast tank body.

19. The personal watercraft of claim 18, wherein the ballast tank is a first ballast tank abutting the rear portion of the pedestal and the first gunnel;

the personal watercraft further comprising:

a second ballast tank disposed at least in part on the rear platform, the second ballast tank abutting the rear portion of the pedestal and the second gunnel, the second ballast tank including:

a rigid ballast tank body;

at least two apertures in the ballast tank body;

a connector releasably connecting the second ballast tank to one of the hull and the deck;

wherein the pump fluidly communicates with one of the at least two apertures in the ballast tank body of the second ballast tank; and wherein the first ballast tank abuts the second ballast tank.

20. The personal watercraft of claim 18, wherein the at least two apertures in the ballast tank body includes:

a water inlet; and at least one water outlet; and wherein the pump fluidly communicates with the water inlet.

21. The personal watercraft of claim 20, wherein the at least one water outlet is at least one overflow aperture disposed in an upper portion of the ballast tank body; and the personal watercraft further comprising:

a drain aperture disposed in a lower portion of the ballast tank body; and a drain plug for selectively plugging the drain aperture.

22. The personal watercraft of claim 18, further comprising a tow pole connected to the deck.

23. The personal watercraft of claim 18, wherein the ballast tank abuts the deck such that the deck prevents movement of the ballast tank in at least three of a forward direction, a rearward direction, a left direction, and a right direction.

* * * * *